US006779518B2

(12) United States Patent
Dobbins

(10) Patent No.: US 6,779,518 B2
(45) Date of Patent: Aug. 24, 2004

(54) PAINTBALL MARKER WITH BODY REARVIEW ELECTRONIC DISPLAY

(75) Inventor: Jerry Dobbins, Nampa, ID (US)

(73) Assignee: National Paintball Supply, Inc., Sewell, NJ (US)

( * ) Notice: Subject to any disclaimer, the term of this patent is extended or adjusted under 35 U.S.C. 154(b) by 0 days.

(21) Appl. No.: 10/280,115

(22) Filed: Oct. 23, 2002

(65) Prior Publication Data

US 2003/0131836 A1 Jul. 17, 2003

Related U.S. Application Data

(60) Provisional application No. 60/347,825, filed on Oct. 23, 2001.

(51) Int. Cl.[7] ..... F41B 11/00
(52) U.S. Cl. ..... 124/71
(58) Field of Search ..... 124/1, 56, 54, 124/71, 72, 70, 80

(56) References Cited

U.S. PATENT DOCUMENTS

| | | | | |
|---|---|---|---|---|
| 5,736,720 | A | 4/1998 | Bell et al. | 235/1 |
| 6,062,208 | A | 5/2000 | Seefeldt et al. | 124/71 |
| 6,311,682 | B1 * | 11/2001 | Rice et al. | 124/71 |

* cited by examiner

*Primary Examiner*—Kien Nguyen
(74) *Attorney, Agent, or Firm*—Volpe and Koenig, P.C.

(57) ABSTRACT

This invention is an electronic display of paintball marker function located on or close to a rear-facing portion of the body of the paintball marker. By paintball marker function is meant mode of operation (e.g., semi- or full-automatic), rate of fire, shot counter, pressure supply, and pressure chambers settings. Also, optionally, a game timer, low battery and on-off indicators may also be displayed. By rear-facing portion of the body is meant on or close to the back panels or surfaces of the marker body above where the firing hand of the player engages the grip of the marker, and behind the trigger location.

6 Claims, 5 Drawing Sheets

PAINTBALL MARKER WITH BODY REARVIEW ELECTRONIC DISPLAY

This application claims priority of Provisional Application Serial No. 60/347,825, filed Oct. 23, 2001, and entitled "Paintball Marker with Body Rearview Electronic Display," which is hereby incorporated by reference.

BACKGROUND OF THE INVENTION

1. Field of the Invention

This invention relates generally to the field of paintball recreation. More specifically, this invention relates to a paintball marker (gun) with a conveniently displayed electronic read-out on a rear-facing portion of the body of the marker.

2. Related Art

Paintball is a growing type of recreation. Numerous new paintball markers and accessories have been introduced to the market in the past several years. For example, electronic control of firing sequence and rate has recently become popular.

With electronic control of the paintball marker has come electronic display of marker functioning, for example, mode of operation (e.g., semi- or full-automatic) rate of fire, shot counting (for ammunition inventory), and game timer. However, to date, this electronic display of paintball marker functions has typically been on a side-facing portion of the gun. For example, prior art electronic paintball marker displays have typically been on a side of the breech or the handle areas of the marker. These display locations, however, are not convenient, and they interfere with the effective playing of the game of paintball. For example, whenever a player wishes to view the marker display at these display locations, the player must stop shooting, and turn the marker sideways to view the display. This results in a significant disruption of the player's ability to continuously play the game.

Therefore, there is a need in the sport of paintball for an electronic display of paintball marker functions which is conveniently located. Also, there is a need for an electronic display which may be continuously viewed without disruption of the player's ability to play the game. This invention addresses that need.

SUMMARY OF THE INVENTION

This invention is an electronic display of paintball marker function located on a rear-facing portion of the body of the paintball marker. By paintball marker function we mean mode of operation (e.g., semi- or full-automatic), rate of fire and shot counter. Optionally, paintball marker conditions may also be displayed. For example, pressure supply, high pressure chamber setting and low pressure chamber setting may also be displayed. Also, optionally, a game timer, low battery and on-off indicators may also be displayed.

By rear-facing portion of the body of the marker we mean on or close to the back panels of the marker body above where the firing hand of the player engages the grip of the marker. Examples of these panels are indicated as areas A, B, and C in FIGS. 1, 2A and 2B, and 3. These back panels of the marker do not include the rear surface of a bulk paintball loader or loader tube. The rear surface of a loader tube is depicted as area D in FIG. 3. These surfaces of the loader are not acceptable because they will require more complex wiring, probably even external wiring, if connected to the electronic micro-controller which is typically conveniently installed in the handle of the paintball marker (for example, see FIG. 4). Also, these loader rear surfaces are not acceptable because they are relatively farther from the player's eyes than areas A, B, and C, placing undue demand on the eyes of the paintball player or on the capabilities of the electronic display.

DETAILED DESCRIPTION OF THE PREFERRED EMBODIMENTS

Figure 1:
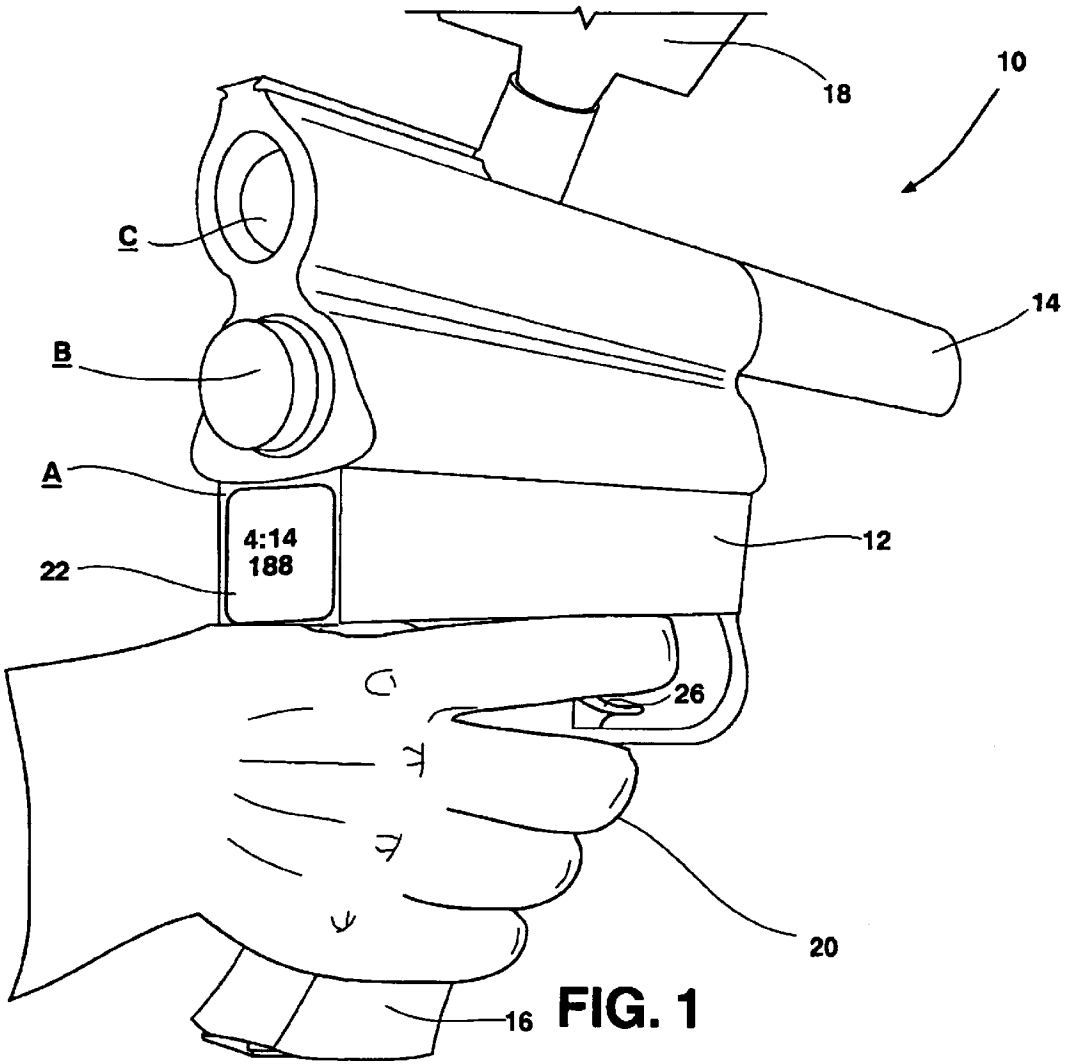
FIG. 1 is a rear, side perspective view of one embodiment of the paintball marker according to the present invention with a body rearview electronic display.

Referring to the Figures, there are depicted several, but not all embodiments of the instant invention. In FIG. 1, paintball marker 10 has body 12, barrel 14, and handle/grip 16. On top of barrel 14 is loading tube 18. Part of paintball payer's hand 20 is also visible in the Figure, the hand 20 engaging the handle-grip 16 of the marker in a firing position.

On the back of the body 12 of the marker, including the back of the barrel 14 where it integrates into the body, and including the back of the handle-grip 16 where it integrates into the body, are rear-facing portions of the body A, B and C. These rear-facing portions have surfaces upon which, or within which, an electronic display 22 of paintball marker function may be located. By rear-facing portions, we mean those surfaces that are visible to the paintball player when the paintball marker is held in the hand in a firing position, and the head of the player is in a sighting position. This way, an electronic display on these rear-facing portions is visible to the player during use of the marker without moving the marker from the firing position, and without requiring that the player move his/her head from the sighting position. Therefore, with the present invention, paintball marker function displayed on the electronic display may be observed by the player without moving the marker from the firing position, and without requiring that the player move his/her head from the sighting position.

Figure 2B:
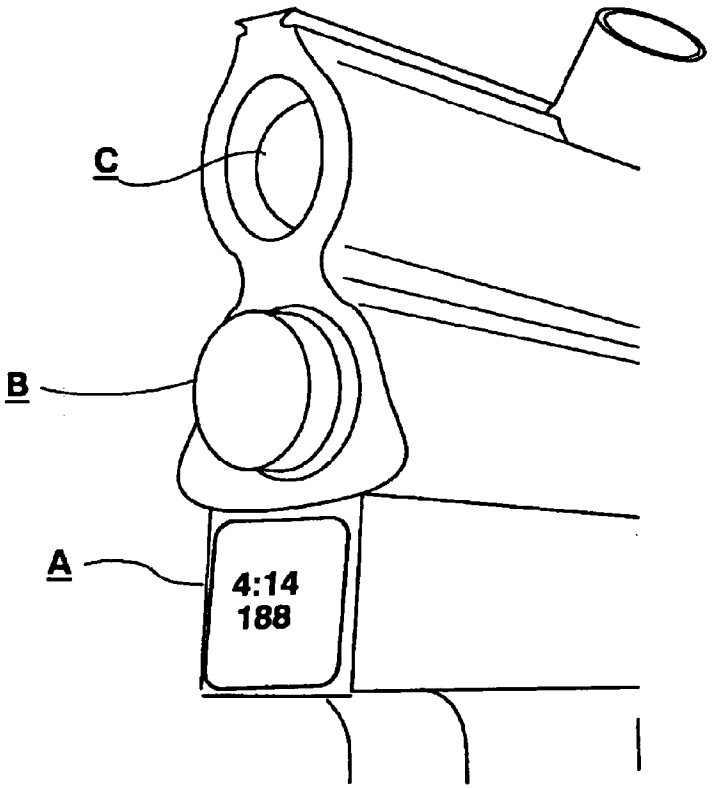
FIGS. 2A and 2B are partial left and right, respectively, rear, side perspective views of the embodiment depicted in FIG. 1, showing different information being displayed.
Figure 2A:
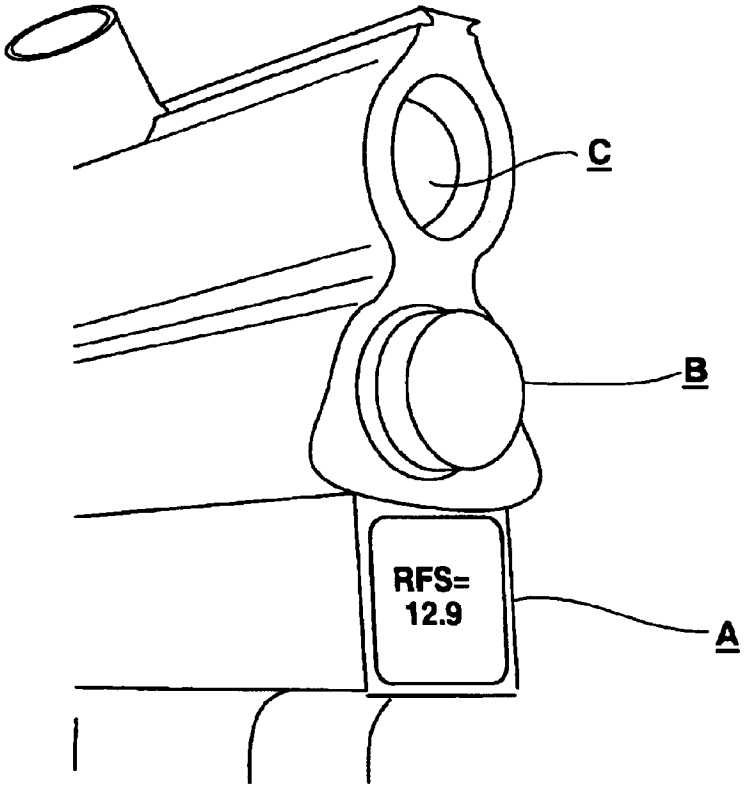

In FIGS. 2A and 2B, electronic display of different screens for paintball marker function are depicted. In FIG. 2A, the rate of fire (12.9 rounds per second—"RPS") is displayed. In FIG. 2B, a game timer (elapsed 4 minutes/14 seconds) and shot counter (188 shots taken) are displayed. Paintball marker function which may be displayed includes, for example: mode of operation (for example, semi- or full-automatic), rate of fire, shot counter, pressure supply, pressure chambers settings, game timer, low battery and on-off indicator. These functions may be displayed individually or in groups. In addition, the display may automatically or manually cycle through different display screens, or have a menu screen for prompting selection of a particular function to be displayed. Visual, as well as audible, signals may emanate from the display. Examples of an audible signal are warning tones, for example, for low battery or high pressure supply, time of game running out, etc.

Figure 3A:
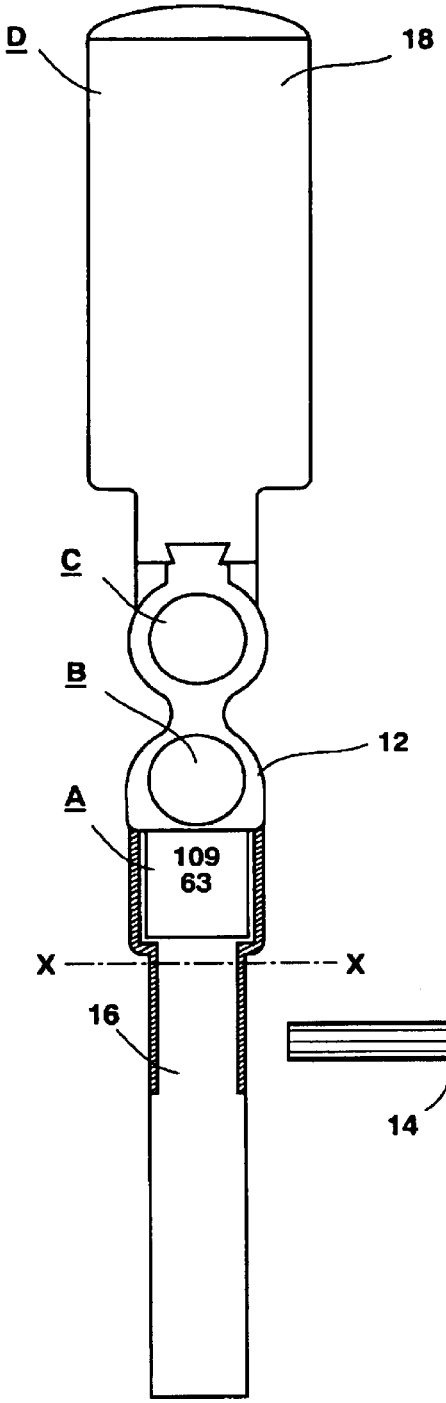
FIG. 3A is a schematic rear view.
Figure 3B:
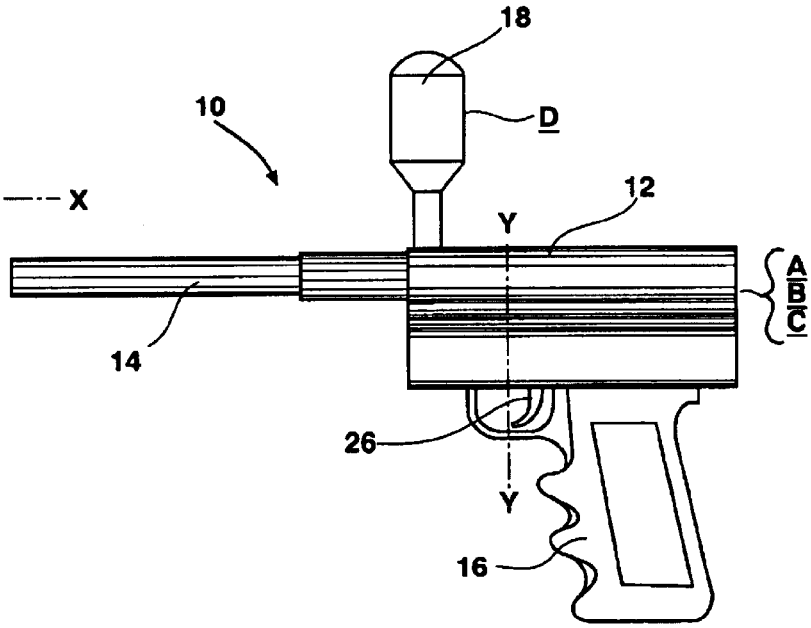
FIGS. 3B is a schematic side view, of another embodiment of the present invention.

In FIG. 3A, rear-facing portions of the marker body A, B and C are depicted. Typically, these rear-facing portions are above the location of line X—X in FIG. 3A, where the firing hand of the player engages the handle-grip 16 of the marker.

In FIG. 3A, line Y—Y is depicted, dividing the marker 10 into a front region, to the left of the trigger 26 in the Figure, and a back region, to the right of the trigger 26. Preferably, the electronic display of the invention is to the rear of the trigger location on the marker. This way, the display may be easily viewed by the player, even when the display is compact.

Figure 4:
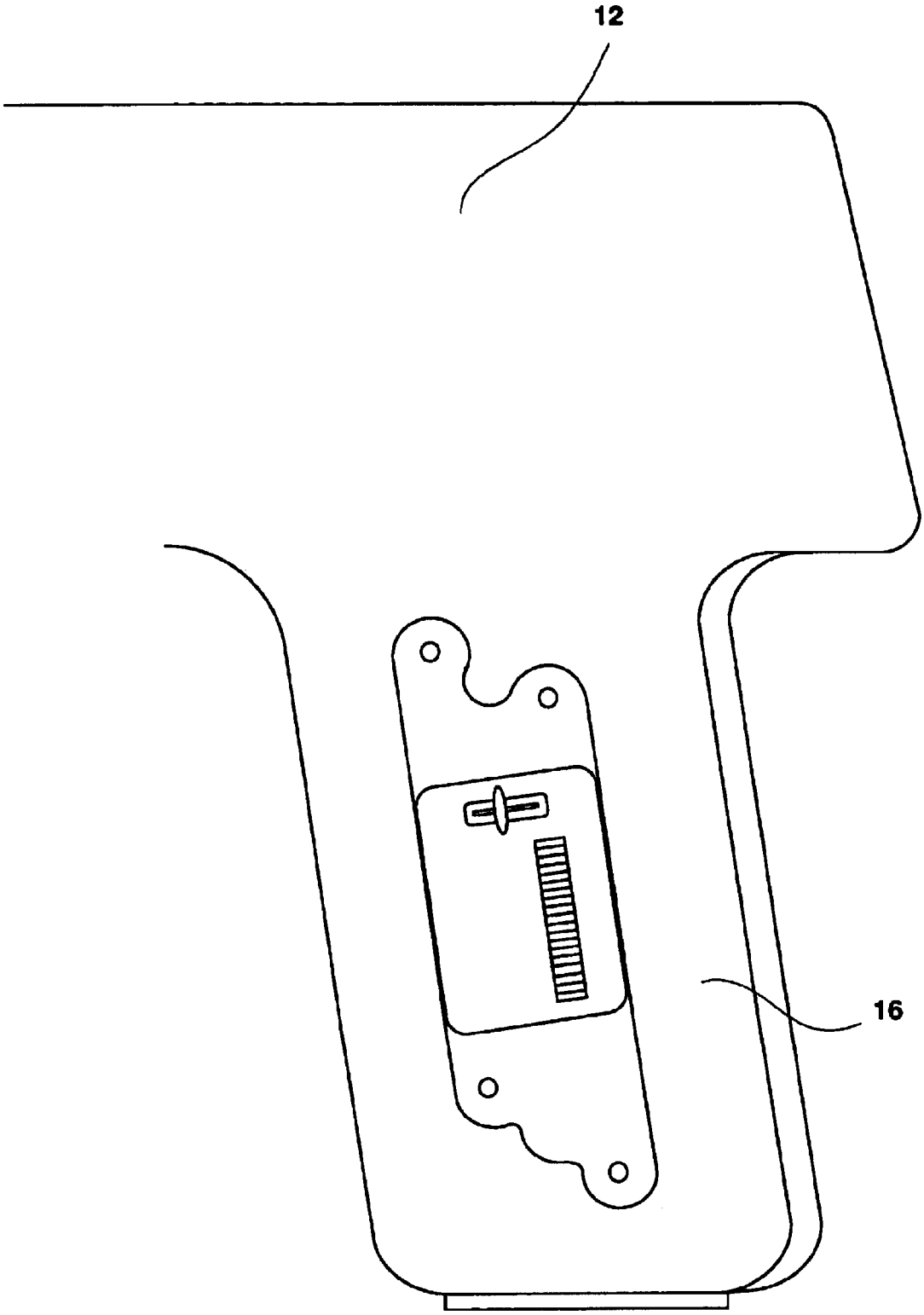
FIG. 4 is a side view of the handle area of an embodiment of the present invention, showing the micro-controller, its switches and display contrast adjuster when the handle cover is removed.

In FIG. 4 is depicted the handle/grip 16 area of the paintball marker 10. Typically, according to the prior art, electronic display of marker function was in this area, which area is not within the view of the player in firing and sighting position.

Figure 5:
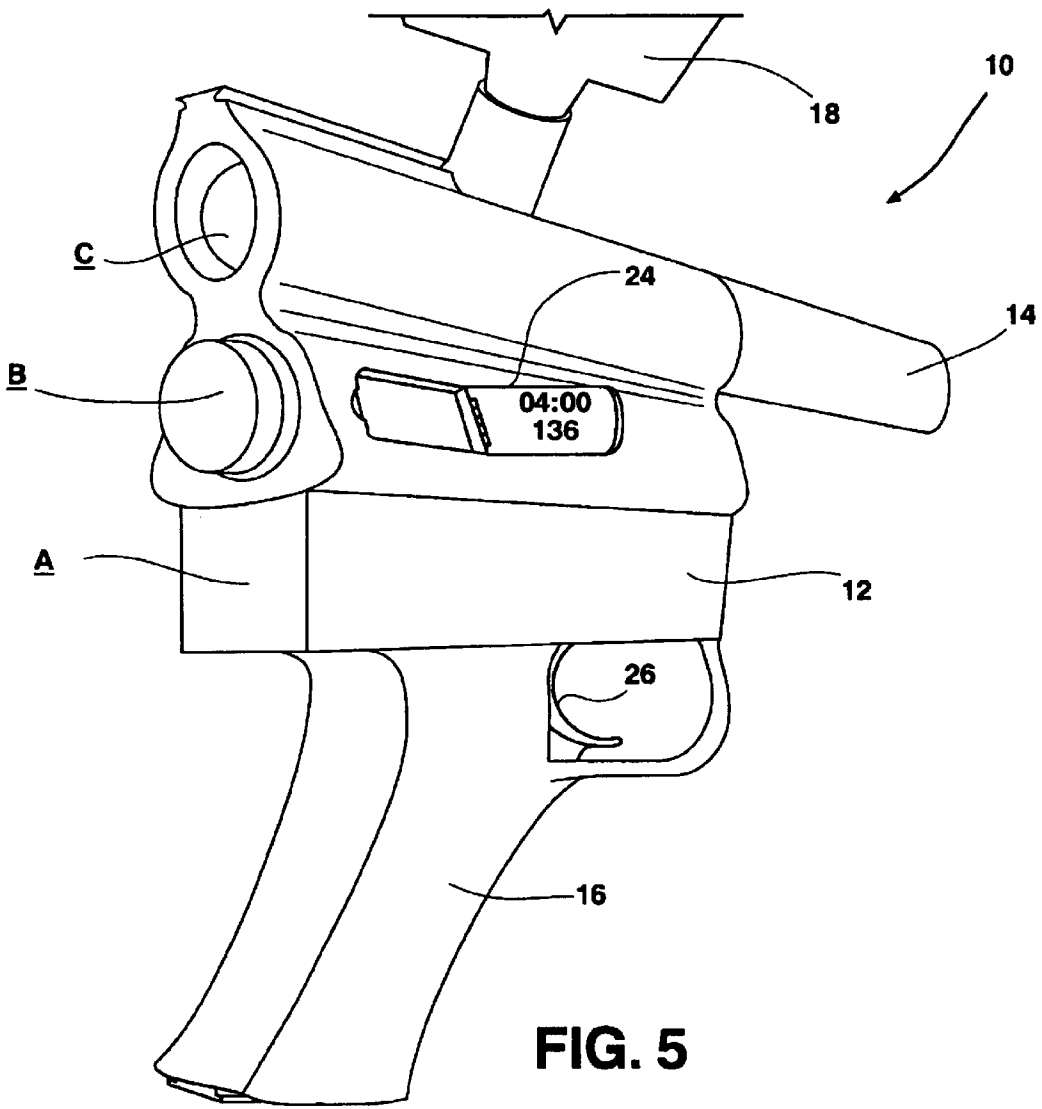
FIG. 5 is a rear, side perspective view of one alternative embodiment of the present invention wherein the body rearview electronic display folds out from the paint ball marker body close to the back panels of the marker body.

In FIG. 5 is depicted an alternative embodiment of the present invention wherein the electronic display is attached to the back, rear-facing panel of an extending body portion 24 pivotally attached, in this instance, to the side of marker body 12, but back behind the trigger 26 of the marker so that the display may be easily viewed by the player.

The display of the instant invention may be conventional in its construction and componentry, whether LCD or LED, etc. However, the display must be sized so that its active area reasonably fits within the areas A, B, or C, or onto the rear-facing surface of a small extending body portion 24.

Although this invention has been described above with reference to particular means, materials and embodiments, it is to be understood that the invention is not limited to these disclosed particulars, but extends instead to all equivalents within the scope of the following claims.

I claim:

1. A paintball marker for use by a paintball player comprising:

a marker body comprising a front region, a rear region having a rear-facing portion, and a trigger located forward of the rear-facing portion; and, an electronic display of paintball marker function located on a rear-facing portion of the marker body rearward of the trigger, whereby the electronic display is within view of a paintball player using the marker when the player is in a firing or sighting position.

2. The paintball marker of claim 1, wherein the marker body further comprises a handle-grip, wherein the electronic display is located on the back of the handle-grip.

3. The paintball marker of claim 1, wherein the marker body further comprises a barrel, wherein the electronic display is located on the back of the barrel.

4. The paintball marker of claim 1, wherein the marker body further comprises a rear-facing panel extending from the marker body and pivotally attached to the marker body at a position rearward of the trigger, wherein the electronic display is attached to the back of the rear-facing panel.

5. A paintball marker for use by a paintball player comprising:

a marker body including a barrel portion having an open end for discharging paintballs, a grip portion adapted to be grasped by a user's hand, and a trigger located forward of the grip portion, the marker body having a rear portion on the opposite side of the marker body from the open end, the rear portion having a side which faces rearward in a direction opposite the open end, the trigger located forward of the rearward facing portion; and an electronic display of paintball marker function located on a rearward facing portion of the marker body, the electronic display being located on the rearward facing portion at a location where it can be viewed by a paintball player using the marker when the grip is held by the player.

6. The paintball marker of claim 5, wherein the display is located on the marker body above the grip.

* * * * *